United States Patent [19]

Harner et al.

[11] Patent Number: 4,853,298

[45] Date of Patent: Aug. 1, 1989

[54] THERMALLY STABLE SUPER INVAR AND ITS NAMED ARTICLE

[75] Inventors: Leslie L. Harner, Fleetwood; Earl L. Frantz, Reading, both of Pa.

[73] Assignee: Carpenter Technology Corporation, Reading, Pa.

[21] Appl. No.: 132,702

[22] Filed: Dec. 10, 1987

Related U.S. Application Data

[63] Continuation-in-part of Ser. No. 849,569, Apr. 8, 1986, abandoned.

[51] Int. Cl.[4] ..... C03C 27/02

[52] U.S. Cl. ..... 428/630; 428/623; 428/433; 420/95

[58] Field of Search ..... 420/95; 148/336; 428/623, 630, 433

[56] References Cited

U.S. PATENT DOCUMENTS

| | | | |
|---|---|---|---|
| 1,942,261 | 1/1934 | Scott | 420/95 |
| 2,062,335 | 12/1936 | Scott | 420/95 |
| 2,277,440 | 1/1941 | Knochel | 420/95 |

OTHER PUBLICATIONS

B. S. Lement et al., *The Dimensional Behavior of Invar*, 43, Transactions of the American Society for Metals, pp. 1072–1097, 32nd Annual Convention (Publ'd 1951).

*Primary Examiner*—Deborah Yee

*Attorney, Agent, or Firm*—Dann, Dorfman, Herrell and Skillman

[57] ABSTRACT

A thermally stable Super Invar has a substantially suppressed martensitic transformation inception point as well as an average coefficient of thermal expansion substantially lower than Invar. The composition in weight percent consists essentially of

| | w/o |
|---|---|
| C | 0.02 Max. |
| Mn | 0.4–0.8 |
| Si | up to 0.25 |
| Ni | 32.0–33.2 |
| Co | 4.5–5.5 |

and the balance iron except for incidental amounts of other elements including up to 0.015 w/o P, 0.015 w/o S, 0.25 w/o Cr, 0.20 w/o Mo, 0.20 w/o. Cu, as well as other incidental elements in amounts which do not undesirably affect the austenitic microstructure or otherwise detract from the desired properties of the alloy. The composition is particularly suited for the manufacture of precision optical articles as well as other articles where minimal expansion mismatch between a metal member and a nonmetal member is required at temperatures of −90° C. (−130° F.) and lower. Moreover, the composition does not sustain stress induced martensite transformation for cold reductions up to 75%.

23 Claims, 1 Drawing Sheet

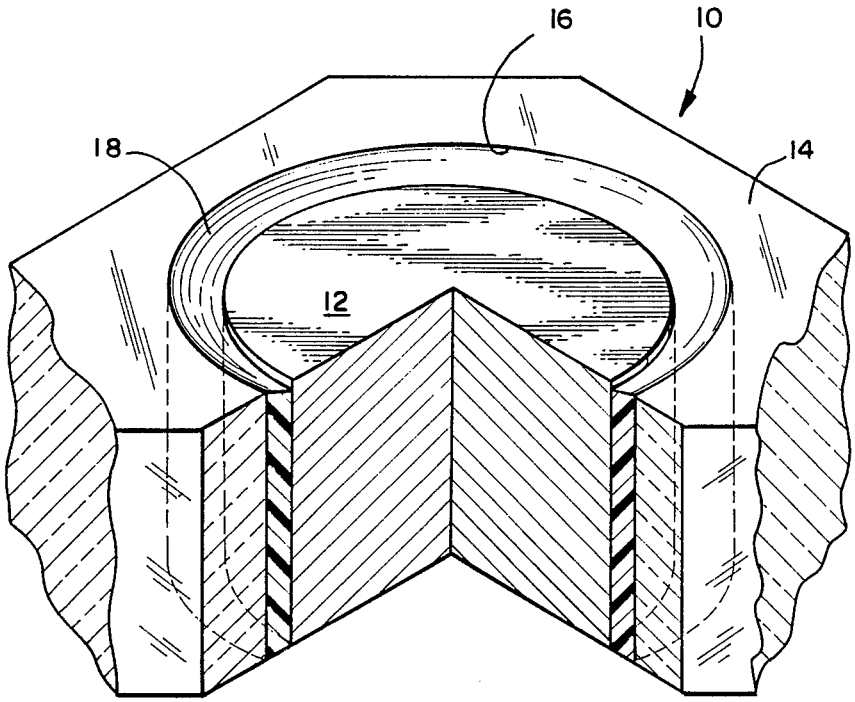
16
10
18
14
12

THERMALLY STABLE SUPER INVAR AND ITS NAMED ARTICLE

This is a continuation-in-part of application Ser. No. 849,569, filed on Apr. 8, 1986, now abandoned.

BACKGROUND OF THE INVENTION

This invention relates generally to low expansion austenitic alloys and more particularly to an alloy and an article formed therefrom for precision optical or other applications requiring dimensional stability at temperatures below −30 C. (−22 F.).

Invar, a low expansion alloy containing nominally 36% by weight nickel—balance iron plus minute quantities of manganese, silicon, and carbon amounting to less than 1 w/o, has a relatively low and exceptionally flat thermal expansion characteristic from about room temperature up to about 200 C. (392 F.). The expansivity of Invar in that temperature range is approximately one-tenth that of stainless steel. For example, "Carpenter Invar 36", a registered trademark for an alloy produced by Carpenter Technology, Inc. of Reading, Pa., assignee of this application, has a mean coefficient of thermal expansion of about $1\times10^{-6}$/°C. to $2\times10^{-6}$/°C. over the temperature range −18 C. to +175 C. (−0.4 F. to +346 F.). Due to its relatively low expansion behavior Invar is often used in such applications as precision optical devices, microscopes, for example, where even small dimensional changes due to temperature fluctuation cannot be tolerated. Invar has also been used in connection with a high expansion alloy to form bimetallic members such as are used in thermostats or the like.

In certain very high precision optical applications, such as ring laser gyroscopes, which are used in environments where extreme subzero temperatures are encountered, it is highly desirable that the low, flat expansion characteristic of Invar be exhibited at temperatures down to about −50 C. or lower. Moreover, due to the extremely low expansivity of the optical glass used in such devices it is critical that the coefficient of thermal expansion of the Invar be very small in order to minimize expansion mismatch between the metal and the glass.

Brace, U.S. Pat. No. 1,689,814 relates to an Invar type alloy containing 1–20% by weight colbalt in which the iron to nickel ratio may vary between 3:1 and 1:1. According to Brace, the addition of the cobalt lowers the coefficient of thermal expansion in the range from room temperature to 300 C. Brace also indicates that the inflection point, i.e. the inception temperature of the ferromagnetic to paramagnetic transition, of Invar is shifted to a lower temperature by decreasing the nickel content while increasing the iron and cobalt content of the alloy.

H. Masumoto, "On the Thermal Expansion of the Alloys of Iron, Nickel and Cobalt, and the Cause of the Small Expansibility of Alloys of the Invar Type", Science Reports, 1st Ser., Vol. 20, Tohaku University Research Institute (1931) relates to nickel-cobalt-iron alloys of the Invar type containing less than 10% cobalt. These alloys are designated by Masumoto as Super Invars because, according to Masumoto the addition of even small amounts of cobalt significantly reduces the coefficient of thermal expansion of conventional Invar.

Super Invar having a nominal composition of 31% nickel—5% cobalt—balance iron exhibits a coefficient of thermal expansion which is less than one-half that of regular Invar. For example, the Super Invar alloy produced by Carpenter Technology, Inc. has a maximum coefficient of thermal expansion of $0.63\times10^{-6}$/°C. from −17.8 C. to 93 C. (0 F. to 200 F.).

Although Super Invar has a substantially lower expansivity than Invar, it is susceptible to martensite transformation in the vicinity of −30 C. (−22 F.), due to its reduced nickel content. It is well known that the austenite to martensite transformation results in a sudden expansion of the metal. In precision optical applications such marked expansion can be catastrophic by causing damage to precision optical glass devices which normally have extremely small expansivities at temperatures substantially below room temperature, for example less than −50 C. (−58 F.).

It is highly desirable, therefore, to have a Super Invar which not only has a very low coefficient of thermal expansion at temperatures from significantly below −50 C. (−58 F.) up to about 100 C. (212 F.), but which also exhibits thermal stability, that is, a martensitic transformation inception point which is controlled so as to fall well below the lowest temperature to be encountered in the particular application. Articles fabricated with such an alloy in close relation to another low expansion material such as glass would be essentially free of risk of damage from expansion mismatch due to the volumetric change which accompanies the martensite transformation.

SUMMARY OF THE INVENTION

Accordingly, it is a principal object of this invention to provide an alloy and article made therefrom having a substantially lower thermal expansion characteristic than Invar and which is thermally stable at substantially lower temperatures than Super Invar.

Another object of this invention is to provide an alloy and article having an average coefficient of thermal expansion no greater than about $0.7\times10^{-6}$/°C. over the temperature range −55 C. to +90 C. (−67 F. to +194 F.).

A further object of this invention is to provide such an alloy and article having a martensite transformation inception point substantially below about −90 C. (−130 F.).

In accordance with the present invention, a low expansion alloy is provided, as well as a precision article incorporating a metal member formed of said alloy and a very low expansion glass element bonded thereto, the alloy in weight percent (w/o) consisting essentially of up to about 0.02 w/o carbon, about 0.4–0.8 w/o manganese, about 32.0–33.2 w/o nickel, about 2.5–5.5 w/o cobalt, and the balance essentially iron. Incidental amounts of other elements including up to 0.25 w/o silicon, up to 0.015 w/o phosphorus, up to 0.015 w/o sulfur, up to 0.25 w/o chromium, up to 0.20 w/o molybdenum, and up to 0.20 w/o copper may be present as well as other elements in amounts which do not undesirably affect the austenitic microstructure or otherwise detract from the desired properties of the alloy. Henceforth in this application percent will be by weight unless otherwise indicated.

BRIEF DESCRIPTION OF THE DRAWING

Further objects as well as advantages of the present invention will be apparent from the following detailed description of the invention and the accompanying drawing which is a cut away elevation view of a precision optical article embodying the invention.

DETAILED DESCRIPTION

In the alloy of the present invention the essential elements are nickel, cobalt, manganese, and iron. Nickel and cobalt are both austenite stabilizers and work together to provide the very low expansion coefficient of the composition of of the present invention. The thermal expansion coefficient of the composition increases dramatically, however, when cobalt is less than about 2.5 w/o or greater than about 5.5 w/o. Accordingly, the present composition contains about 2.5–5.5 w/o cobalt. Preferably about 3.5–5.3 w/o cobalt is present and for best results about 4.0–5.0 w/o cobalt is present in the composition. The coefficient of thermal expansion of the present composition is also sensitive to nickel content. Nickel much in excess of about 33 w/o also causes unacceptable increases in the thermal expansion coefficient. Accordingly, nickel content is limited to a maximum of about 33.2 w/o, and preferably up to about 32.8 w/o.

The reduced nickel content of the composition relative to Invar destabilizes the austenitic structure since cobalt is not as strong as austenite stabilizer as nickel is. Accordingly, without more, the present alloy could undergo martensite transformation at an unacceptably high temperature, e.g. in the vicinity of −30 C. (−22 F.). The martensite transformation start temperature, $M_s$, can be lowered by providing a minimum of about 32.0 w/o, preferably about 32.2 w/o, nickel in this composition. To achieve both a very low average coefficient of thermal expansion and a significantly lower $M_s$ temperature, the combined amount of nickel and cobalt should be in the range of about 35–38 w/o, and preferably about 36–37.5 w/o.

Manganese has a strong austenite stabilizing effect in the nickel-cobalt-iron system of Super Invar. Additions of manganese, however, also strongly increase the average coefficient of thermal expansion. The inclusion of about 0.4–0.8 w/o, preferably at least about 0.6 w/o, manganese lowers the $M_s$ temperature without appreciably increasing the thermal expansivity of the composition. The present composition exhibits martensite transformation suppression to below −90 C. (−130 F.) when manganese is in the range of about 0.4–0.5 w/o. Martensite transformation is suppressed to below −120 C. (−184 F.) when manganese is greater than about 0.5 w/o.

Carbon is usually present in the composition due to the realities of melting practice. Carbon is intentionally kept very low, however, no more than about 0.02 w/o, being the tolerable maximum preferably no more than about 0.01, e.g. 0.012 w/o, better yet up to about 0.005 w/o. Carbon is a strong austenite former and as such it is beneficial to the alloy. However, carbon significantly increases the coefficient of expansion and therefore can be tolerated only in minute amounts.

Furthermore, in amounts greater than these carbon can produce dimensional instability in the austenite matrix. The alloy can be heat treated in order to minimize the risk of dimensional instability due to carbon as will be described more fully herein below.

Silicon, although having little effect on either $M_s$ temperature or coefficient of expansion, is beneficial to the hot working properties of the alloy and can be present in amounts up to about 0.25 w/o. Other incidental additions including chromium, molydenum, and copper may be present in amounts which do not tend to destabilize the austenitic microstructure of the composition or objectionably detract from the expansion properties. In this regard up to about 0.25 w/o chromium, up to about 0.20 w/o molybdenum, and up to about 0.20 w/o copper may be present in the composition. Phosphorus and sulfur are preferably kept low since they can deplete the manganese content by forming unwanted inclusions such as manganese sulfide in the composition, thereby upsetting the chemical balance. Accordingly, not more than 0.015 w/o of either are present. As has been pointed out hereinabove, the balance of the composition is iron. Trace amounts of other elements which do not significantly detract from the desired properties of the composition or significantly increase its coefficient of thermal expansion may also be present.

The present composition is balanced within its broad range to provide a coefficient of thermal expansion of up to about $0.7\times10^{-6}/°C$. As a further advantage, the composition provides a coefficient of thermal expansion of up to about $0.5\times10^{-6}/°C$. within its preferred range.

The composition is prepared using conventional metallurgical techniques, vacuum induction melting being preferred to maintain purity. The alloy is readily hot and cold worked. It is a feature and a distinct advantage of the present composition that is does not sustain any observable stress-induced martensite transformation for cold reductions up to 75%. A suitable temperature for hot working is about 2150 F. (1178 C.). Articles for use in precision devices such as the optical device shown in the drawing are readily fabricated from the finished material.

Articles formed from the alloy are heat treated to reduce the dimensional instability caused by carbon aging a phenomenon in which such articles undergo dimensional variation due to precipitation of carbon in the alloy over time. A three stage heat treatment improves the thermal expansion coefficient and concurrently imparts greater dimensional stability by accelerating the carbon aging.

In the first stage of the heat treatment, the article is heated in the temperature range 1200–1900 F. (650–1040 C.) for a time sufficient to anneal or mechanically soften the alloy. The article is quenched from the annealing temperature in a manner to maintain the mechanical softness. A water quench is preferred for this purpose.

In the second stage the article is heated in the range 500–800 F. (260–425 C.) for a time sufficient to relieve any stresses resulting from the post-anneal quench. The article is air cooled from the stress relieving temperature.

In the third stage, the article is heated in the range 200–400 F. (95–205 C.) for about 24–48 hours, a time sufficient for dimensional variation due to carbon precipitation in the alloy to reach a substantially steady state condition.

The heat treatment parameters will vary in a time-temperature relationship, however, depending on the cross section of the alloy. For example, dilatometer specimens 2 in (5.08 cm) long having diameters of 0.18 in (0.46 cm) were first heated to 1500 F. (about 816 C.) for one hour and then water quenched. The specimens were then heated to 600 F. (about 315 C.) for one hour followed by cooling in air. The specimens were then heated to 200 F. (about 93 C.) for twenty-four hours, followed by air cooling again.

Referring now to the drawing there is shown a precision optical device 10 including a metal member 12 bonded to a glass member 14 by a bonding agent 18. The glass member 14 is formed of a low expansion optical glass and has a central opening 16. The average coefficient of thermal expansion of glass member 14 is about $0.03\times10^{-6}$/°C. from −55 C. to +90 C.

Metal member 12 which is formed from the previously described alloy has an average coefficient of thermal expansion no greater than about $0.7\times10^{-6}$/°C. preferably no greater than $0.5\times10^{-6}$/°C. over the same temperature range, thereby providing an acceptable expansion mismatch. Although acceptable expansion mismatch is dependent on the strength of the glass member 14 and the bonding agent 18, an acceptable mismatch can be defined as when the difference in thermal expansion between metal member 12 and the glass member 14 and bonding agent 18 is such that the glass and bonding agent remain intact or are not distorted to the degree of inoperativeness. Moreover, metal member 12 is dimensionally stable in that it does not begin to undergo martensitic transformation until below −90 C. (−130 F.) Metal member 12 is mounted within the central opening 16 of glass member 14. The bonding agent 18 may consist of epoxy or some similar strong bonding agent which is relatively rigid upon curing. The dimensional stability of metal member 12 renders it significantly less prone to cause damage to the glass member 14 by transformation related expansion.

The following examples are illustrative of the present invention. Examples 1–5 were melted under vacuum as relatively small, experimental heats having the compositions, in weight percent, shown in Table I. The balance in each case was iron and incidental elements which included 0.005 w/o max phosphorus, 0.001–0.002 w/o sulfur, 0.06–0.10 w/o chromium, less than 0.01 w/o molybdenum, less than 0.005 w/o aluminum, and about 0.01 w/o max copper.

| Ex. | C | Mn | Si | Ni | Co |
|---|---|---|---|---|---|
| 1 | .001 | .49 | .08 | 32.07 | 3.11 |
| 2 | <.001 | .49 | .08 | 32.18 | 3.60 |
| 3 | <.001 | .48 | .10 | 32.17 | 3.91 |
| 4 | <.001 | .50 | .10 | 32.15 | 4.64 |
| 5 | .002 | .50 | .10 | 32.10 | 5.23 |

The heats were cast into ingots which were hot pressed from a temperature of 2150 F. (1177 C.) to provide ½ in (1.27 cm) square bars. Dilatometer specimens 2 in (about 5.08 cm) long having diameters of 0.18 in (0.46 cm) were prepared from the ½ in square bar and heat treated in the following way: heated at 1500 F. (816 C.) for one hour then water quenched; heated at 600 F. (316 C.) for one hour then air cooled; and heated at 200 F. (93.3 C.) for 24 hours and then air cooled to room temperature.

The coefficient of thermal expansion for specimens of each heat were measured on a differential dilatometer from room temperature up to 95 C. (203 F.) and from room temperature down to −120 C. (−184 F.) or to the $M_s$ temperature for each sample. The samples were each measured differentially against a sample of fused silica glass (NBS Standard Reference Material No. 739) which is known to have a coefficient of expansion of $0.45\times10^{-6}$/°C. over the temperature range of interest. The average coefficient of thermal expansion determined for each sample over the range −55 C. to +90 C. (−67 F. to +194 F.) is listed in Table II as well as the respective $M_s$ temperatures determined for the respective sample.

| Ex. | Avg. Coeff. ($\times 10^{-6}$/°C.) | ($M_s$) Temp. (°C.) |
|---|---|---|
| 1 | 0.34 | −103 |
| 2 | 0.21 | −103 |
| 3 | 0.07 | −106 |
| 4 | 0.01 | <−120 |
| 5 | 0.33 | <−120 |

The data of Tables I and II show the dramatic increase in the thermal expansion coefficient of the present alloy near the low and high ends of the claimed range for cobalt.

Examples 6–10 were vacuum induction melted, 300 pound experimental heats having compositions in weight percent shown in Table III. The balance in each case was iron and incidental elements which included less than 0.005 w/o phosphorus, 0.002–0.003 w/o sulfur, less than 0.01 w/o chromium, less than 0.01 w/o molybdenum, and less 0.01 w/o copper.

TABLE III

| Ex. | C | Mn | Si | Ni | Co |
|---|---|---|---|---|---|
| B6 | .010 | .51 | <.01 | 32.52 | 5.19 |
| B7 | .010 | .51 | <.01 | 32.55 | 5.24 |
| B8 | .009 | .51 | <.01 | 32.60 | 5.27 |
| B9 | .012 | .51 | <.01 | 32.31 | 5.24 |
| B10 | .012 | .51 | <.01 | 32.61 | 5.23 |

Dilatometer specimens 2.0 in (5.08 cm) long having 0.2 in (about 0.51 cm) square cross sections were machined from 4 inch square sections cut from billets prepared from the as-cast heats. The specimens were heat treated similarly to Examples 1–5.

The coefficient of thermal expansion for each sample was measured on a differential dilatometer from 24 C. (75 F.) up to 100 C. (212 F.) and from 24 C. (75 F.) down to the $M_s$ temperature. The average coefficients of thermal expansion determined for each sample over the range −65 C. to +93 C. (−85 F. to +199 F.) are listed in Table IV as well as the $M_s$ temperatures.

TABLE IV

| Ex. | Avg. Coff. ($\times 10^{-6}$/°C.) | $M_s$ Temp (°C.) |
|---|---|---|
| B6 | .42 | −97 |
| B7 | .45 | −99 |
| B8 | .36 | −99 |
| B9 | .39 | −94 |
| B10 | .40 | −106 |

The alloy according to this invention, and articles manufactured therefrom, not only exhibit substantially lower thermal expansivity than Invar at temperatures ranging from −55 C. to +90 C. (−67 F. to +194 F.), but also exhibit substantially improved thermal stability to below −90 C. (−130 F.). It is contemplated that the alloy and articles produced therewith will have wide application in extremely low temperature environments particularly in high precision optical devices where minimal expansion mismatch between a glass member and the adjoining metal member is required.

The terms and expressions which have been employed are used as terms of description and not of limitation. There is no intention in the use of such terms and expressions to exclude any equivalents of the features shown and described or portions thereof. However, it is recognized that various modifications are possible within the scope of the invention claimed.

What is claimed is:

1. A low thermal expansion austenitic alloy which exhibits a martensitic transformation start temperature below −90 C. (−130 F.), an average coefficient of thermal expansion up to about $0.7\times10^{-6}$/°C. from −55 C. to +90 C. (−67 F. to +194 F.), and which does not sustain stress-induced martensite transformation for cold reductions up to 75%, said alloy, in weight percent, consisting essentially of about

| | w/o |
|---|---|
| Carbon | 0.02 Max. |
| Manganese | 0.4–0.8 |
| Silicon | Up to 0.25 |
| Nickel | 32.0–33.2 |
| Cobalt | 2.5–5.5 |

and the balance essentially iron.

2. An alloy as recited in claim 1 having a martensitic transformation start temperature below −120 C. (−184 F.) which contains at least about 0.5 w/o manganese.

3. An alloy as recited in claim 1 containing up to 0.01 w/o carbon.

4. An alloy as recited in claim 3 containing up to 0.005 w/o carbon.

5. An alloy as recited in claim 1 containing no more than about 5.3 w/o cobalt.

6. An alloy as recited in claim 5 containing at least about 3.5 w/o cobalt.

7. An alloy as recited in claim 1 containing no more than about 32.8 w/o nickel.

8. An alloy as recited in claim 7 containing at least 32.2 w/o nickel.

9. An alloy as recited in claim 1 wherein the combined content of nickel and cobalt is about 35–38 w/o.

10. An alloy as recited in claim 9 wherein the combined content of nickel and cobalt is about 36–37.5 w/o.

11. A precision article comprising:

a low expansion glass member; and a dimensionally stabilized metal member adjoining said glass member in close relation, said dimensionally stabilized metal member formed from an austenitic alloy having both a martensitic transformation start temperature below −90 C. (−130 F.) an average coefficient of thermal expansion no greater than $0.7\times10^{-6}$/°C. from −55 C. to +90 C. (−67 F. to +194 F.), said alloy, in weight percent, consisting essentially of about

| | w/o |
|---|---|
| Carbon | 0.02 Max. |
| Manganese | 0.4–0.8 |
| Silicon | Up to 0.25 |
| Nickel | 32.0–33.2 |

-continued

| | w/o |
|---|---|
| Cobalt | 2.5–5.5 |

and the balance essentially iron.

12. An article as recited in claim 11 wherein said dimensionally stabilized metal member has a martensitic transformation start temperature below −120 C. (−184 F.) and contains at least about 0.6 w/o manganese.

13. An article as recited in claim 12 wherein said metal member contains up to about 0.01 w/o carbon.

14. An article as recited in claim 13 wherein said metal member contains up to 0.005 w/o carbon.

15. An article as recited in claim 11 wherein said metal member contains no more than about 5.3 w/o cobalt.

16. An article as recited in claim 15 wherein said metal member contains at least about 3.5 w/o cobalt.

17. An article as recited in claim 11 wherein said metal member contains no more than about 32.8 w/o nickel.

18. An article as recited in claim 17 wherein said metal member contains at least 32.2 w/o nickel.

19. An article as recited in claim 11 wherein said metal member has a combined content of nickel and cobalt of about 35–38 w/o.

20. An article as recited in claim 19 wherein said metal member has a combined content of nickel and cobalt of about 36–37.5 w/o.

21. An article as recited in claim 11 wherein the metal member is dimensionally stabilized by heat treating said metal member to accelerate the dimensional variation in the metal member due to precipitation of carbon within the alloy.

22. An article as recited in claim 21 wherein the metal member is heat treated by annealing the metal member in the temperature range 1200–1900 F., quenching the annealed metal member in water, stress relieving the metal member in the temperature range 500–800 F., cooling the stress relieved member in air, and then heating the metal member in the temperature range 200–400 F. for a time sufficient for the dimensional variation due to carbon precipitation in the alloy to reach a substantially steady state condition.

23. A low thermal expansion austenitic alloy which exhibits a martensitic transformation start temperature below −120 C. (−184 F.), an average coefficient of thermal expansion up to about $0.5\times10^{-6}$/°C. from −55 C. to +90 C. (−67 F. to +194 F.), and which does not sustain stress-induced martensite transformation for cold reductions up to 75%, said alloy, in weight percent, consisting essentially of about

| | w/o |
|---|---|
| Carbon | Up to 0.01 |
| Manganese | 0.5–0.6 |
| Silicon | Up to 0.25 |
| Nickel | 32.2–32.8 |
| Cobalt | 3.5–5.3 |

and the balance essentially iron.

* * * * *

UNITED STATES PATENT AND TRADEMARK OFFICE

CERTIFICATE OF CORRECTION

PATENT NO. : 4,853,298

DATED : AUGUST 1, 1989

INVENTOR(S) : LESLIE L. HARNER and EARL L. FRANTZ

It is certified that error appears in the above-identified patent and that said Letters Patent is hereby corrected as shown below:

On the title page,
item [57] ABSTRACT,

Second and third lines after the table, "0.015" should read --up to 0.015--; "0.25" should read --up to 0.25--; and "0.20" should read --up to 0.20-- each occurrence; "w/o." last occurrence should read --w/o--.

Column 5,

Line 39, the table should include "TABLE I" as the heading.

Column 6,

Line 3, the table should include "TABLE II" as the heading;

In Table II, the column under "($M_s$) Temp.", "-103" (first occurrence) should be -- -105 --;

Table III, in the column under "Ex." the numbers "B6", "B7", "B8", "B9", and "B10" should be --6--, --7--, --8--, --9--, and --10--, respectively;

UNITED STATES PATENT AND TRADEMARK OFFICE

CERTIFICATE OF CORRECTION

PATENT NO. : 4,853,298

DATED : AUGUST 1, 1989

INVENTOR(S) : LESLIE L. HARNER AND EARL L. FRANTZ

It is certified that error appears in the above-identified patent and that said Letters Patent is hereby corrected as shown below:

Column 6,

Table IV, in the column under "Ex." the numbers "B6", "B7", "B8", "B9", and "B10" should be --6--, --7--, --8--, --9--, and --10--, respectively.

Signed and Sealed this

Twenty-ninth Day of May, 1990

*Attest:*

HARRY F. MANBECK, JR.

*Attesting Officer*

*Commissioner of Patents and Trademarks*